United States Patent [19]

Mattis

[11] Patent Number: 4,717,355

[45] Date of Patent: Jan. 5, 1988

[54] COAXIAL CONNECTOR MOISTURE SEAL

[75] Inventor: John S. Mattis, Sunnyvale, Calif.

[73] Assignee: Raychem Corp., Menlo Park, Calif.

[21] Appl. No.: 922,607

[22] Filed: Oct. 24, 1986

[51] Int. Cl.[4] ..... H01R 13/58

[52] U.S. Cl. ..... 439/452; 439/584; 439/273; 439/548

[58] Field of Search ..... 339/177, 94, 59–63, 339/213 R, 48, 88, 89 C, 89 R, 276 R; 285/334, 334.1, 334.2, 334.3, 334.4, 334.5

[56] References Cited

U.S. PATENT DOCUMENTS

| | | | |
|---|---|---|---|
| 3,359,013 | 12/1967 | Knox et al. | 285/334 |
| 3,671,922 | 6/1972 | Zerlin et al. | 339/177 R |
| 3,904,264 | 9/1975 | Oertle | 339/177 R |
| 4,009,893 | 3/1977 | Schatton et al. | 285/334 |
| 4,580,862 | 4/1986 | Johnson | 339/177 R |
| 4,618,198 | 10/1986 | Dale et al. | 285/334.4 |
| 4,674,818 | 6/1987 | McMills et al. . | |

*Primary Examiner*—Gil Weidenfeld
*Assistant Examiner*—David Pirlot
*Attorney, Agent, or Firm*—Dennis E. Kovach

[57] ABSTRACT

A plug for sealing an end of a coupling assembly secured to an end of a coaxial cable includes a flange having an end face which has a cross-sectional area substantially less than a cross-sectional area of a threaded portion of the plug, the end face being urged against an end face of the coupling assembly to form a seal therewith.

6 Claims, 3 Drawing Figures

COAXIAL CONNECTOR MOISTURE SEAL

BACKGROUND OF THE INVENTION

The present application is an improvement over the invention disclosed by McMills et al. in U.S. Pat. No. 4,583,811 assigned to the assignee of the present application, the disclosure of which is incorporated herein by reference.

McMills et al. discloses a mechanical coupling assembly for coupling a coaxial cable to a coaxial cable dropwire splice box, and includes a deformable compressive member which seals a space between an outer layer of a coaxial cable being coupled and a connector body disposed over this outer layer. Driver means are used for compressing the deformable compressive member, and the driver means is engageable via threads with a male threaded member extending from the dropwire splice box. Though the deformable compressive member provides an excellent means for preventing moisture ingress into the connection so formed between the outer layer of the cable and the connector body, a problem still exists in the art of how to seal an end of the cable when the driver means is attached thereto but is not also attached to the dropwire splice box or similar connection.

For example, oftentimes after the driver means has been attached to the cable and the dropwire splice box, it is necessary to disconnect the driver means from the dropwire splice box such as can be required when cable service is discontinued by a subscriber. Subsequent to disconnection, the mechanical coupling assembly can be removed from the coaxial cable, but this is disadvantageous since the then exposed end of the coaxial cable is susceptible to absorbing water and other environmental contaminants which will require that a substantial length of the cable be rendered useless should service thereafter be desired and reconnection be required. In such an instance, a substantial length of the coaxial cable must simply be cut off and thrown away.

Though it is possible to plug an end of the cable with some kind of grease, this is disadvantageous since greases are messy and tend to ooze and flow over time, and accordingly do not provide optimum moisture ingress protection.

SUMMARY OF THE INVENTION

Accordingly, it is an object of the invention to provide an apparatus which seals an end of a cable, and specifically which seals a cable connector having an exposed face surrounded by an internal surface, the face and the internal surface defining a cavity having an open side, comprising:

a plug having threads engageable with the connector so as to close the cavity, an end face of the plug confronting the connector exposed face having formed therein a surface having an outermost cross-sectional area substantially less than the cross-sectional area of a threaded portion of the plug, the plug including a flange which interconnects the plug threaded portion and the plug end face, the flange having a cross-sectional area substantially less than the plug threaded portion Preferably, the flange has a conical shape, a longitudinal axis of the flange being substantially parallel to a longitudinal axis of the plug, an inner surface of the flange diverging outward along a direction away from the plug threaded portions, the plug threads being external threads engageable with internal threads of the connector.

DESCRIPTION OF THE PREFERRED EMBODIMENTS

Figure 1:
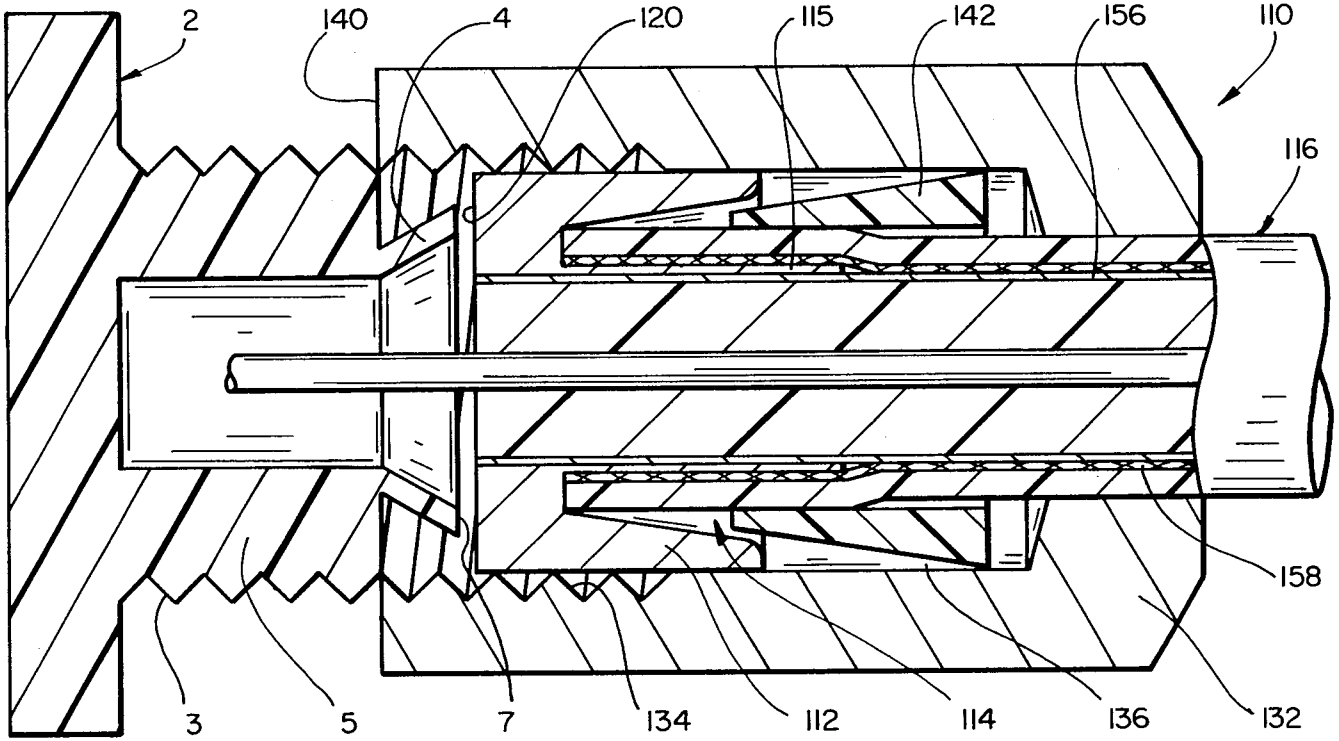
FIGS. 1 and 2 illustrate a first preferred embodiment of the invention, with FIG. 1 illustrating a plug in a disassembled state relative to a coupling assembly, and FIG. 2 illustrating the state where the plug has been secured to the coupling assembly.

Referring to FIG. 1, a connector or coupling assembly 110 includes a connector body 112 having a mating area 114, driver means 132 having threads 134 and a rear face 140, and a compressive member 142. The coupling assembly 110 is adapted to be connected to a wall mounting unit (not shown), e.g., a tap box, via a bolt member having external threads engageable with the internal threads 134 of the driver means 132. According to such a coupling assembly, delicate foil shielding and braided layers 156, 158 are separated from the cable 116 by the connector body 112 which includes the mating area 114 for contacting the braided layer, the connector body having a distal end 115 which is preferably sharpened to wedge between the delicate foil layer 156 and the braided layer 158. The distal end 115 is elongated and sharpened and allows a visual means for the craftsman to assure that the braided layer is, in fact, separated from the foil shield and is being properly positioned on the exterior of portion 115 of the connector body 112, i.e., on the mating area 114, as the connector body 112 is being positioned on the cable 116.

The driver means 132 and the compressive member 142 are slipped over the cable prior to engaging the distal end 115 into the cable. The driver means 132 is then threadedly secured to another member, in the embodiment shown plug 2, via engaging threads and thereby provides the means for urging the connector body 112 and driver means 132 toward each other to deform the compressive member, as best illustrated by comparing FIGS. 1 and 2. A space 136 created between the driver means 132 and the connector body 112 is occupied by the compressive member 142 as the driver means is tightened which produces a protuberance 124 in cable protective jacket 144 which serves to lock the cable 116 to the body 112 and provides a moisture seal downstream in series with a path defined by a junction between the connector body 112 and the driver means 132.

The invention provides a means for sealing an end of the coupling assembly 110, especially an end of the cable 116 when the coupling assembly 110, and specifically the cable 116, is not connected to a wall mounting unit or similar structure. In this case an end of the cable remains electrically unconnected. A seal is achieved using the plug 2 which has external threads 3 engageable with the internal threads 134 of the driver means 132. Preferably the plug is made entirely out of plastic, and has an overall length of less than four inches, preferably less than two inches, e.g. about one inch.

A longitudinal end portion 4 of the plug which confronts an exposed end 120 of the coupling assembly 110 constitutes a flange, the flange 4 having a cross-sectional area substantially less than a cross-sectional area of a portion 5 of the plug 2 having the external threads 3 therearound. In particular, a cross-sectional area of the longitudinal end-most section 7 of the flange 4 of the plug 2 has a cross-sectional area substantially less than the plug portion 5, the cross-sectional area of the plug threaded portion 5 being between 2 and 20 times, preferably 3–10 times, e.g. 3–8 times, the cross-sectional area of the flange 4 or the section 7. Accordingly, when the plug 2 is screwed into the driver means 132, very high stresses can be developed between the longitudinal end-most section 7 of the plug 2 and the exposed end 120 of the connector body 112 with very little plug turning force since the contact surface area therebetween is kept small, and accordingly an excellent seal is obtained.

Figure 2:
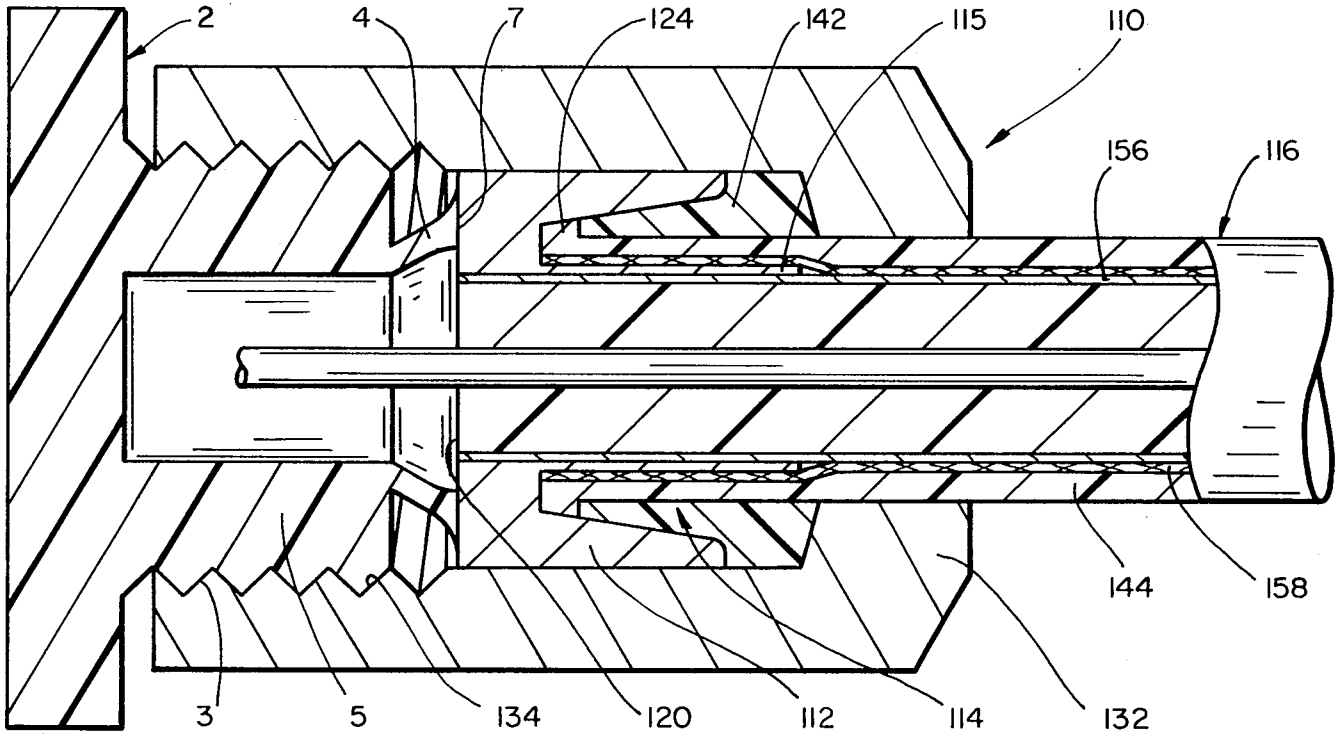

According to the embodiment shown in FIGS. 1 and 2, the plug portion 4 has a conical shape, the invention including other shapes as well, such as uniform cylindrical shapes and conical shapes having different angles of divergence or convergence relative to a longitudinal axis of the plug 2. In addition, preferably the plug portion 5 is cylindricaly shaped as is an internal surface of the driver means 132.

As FIG. 2 illustrates, subsequent to engaging the plug 2 with the coupling assembly 110 by screwing the plug 2 within the driver means 132, both an excellent seal can be obtained between the plug portion 5 and the connector body face 120, as well as between the compressive member 142 and the cable jacket 144 and the connector body 112. Accordingly, all moisture paths to the end of the coaxial cable are blocked.

Figure 3:
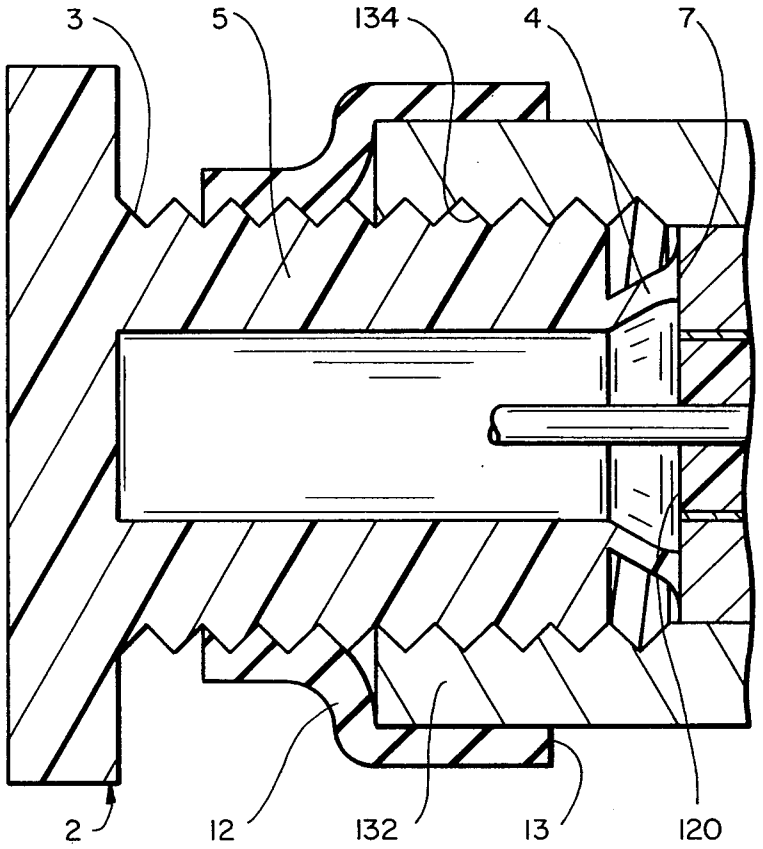
FIG. 3 illustrates a second preferred embodiment of the invention.

FIG. 3 illustrates a further preferred embodiment of the invention, the additional feature set forth in this embodiment being the use of an elongated elastomeric ring having a substantially uniform cross-section along its entire length, a relaxed inside diameter of the elastomer 12 being preferably both uniform and smaller than an external diameter of the outer threads 3 of the plug 2 and an outermost diameter of the driver means 132, and preferably an outermost nut surface thereof. A preferred ring construction is disclosed in U.S. Pat. No. 4,674, 818, assigned to the assignee of the invention, the disclosure of which is incorporated herein by reference.

Assembly of the embodiment of FIG. 3 is relatively craft insensitive since the elastomer 12 can be disposed around the threads of the plug 2 by simply screwing the elastomer 12 thereon, and thereafter the plug threads 3 can be screwed within the driver means 132 while being careful to allow an end 13 of the elastomer 12 to ride up over an exposed end of the driver means 132 thus resulting in the assembly shown in FIG. 3. This embodiment is advantageous since the elastomer 12 works in series with the plug portion 7, 5 to prevent moisture ingress into the end of the coaxial cable.

According to a particularly preferred embodiment, the elastomer 12 is relatively short in length, being approximately a quarter to one-half inch in length, has a uniform cross-section throughout, and has an unrelaxed diameter which is about 10–40% smaller than an outermost diameter of the driver means and/or the plug threads 3.

The plug of the invention is especially well suited for sealing a coupling assembly useable with a coaxial cable dropwire especially suitable for CATV coaxial cable wire boxes. However, the invention is equally useful in any situation where a cable to be terminated or connected is required to have some sort of seal prior to being connected to a permanent installation.

Though the invention has been described with certain preferred embodiments thereof, it should be appreciated that the invention is not limited thereto and is to be limited only by the appended claims.

What is claimed is:

1. An apparatus for sealing a coaxial cable, comprising:

a connector disposed on an end of the cable so as to terminate the cable, the connector having an exposed face surrounded by an internal surface, the face and the internal surface defining a cavity having an open side, the face forming part of the cable end, and a plug having threads engageable with the connector so as to close the cavity, an end face of the plug confronting the connector exposed face having formed therein a surface having an outermost cross-sectional area substantially less than the cross-sectional area of a threaded portion of the plug, the plug including a flange which interconnects the plug threaded portion and the plug end face, the flange having a cross-sectional area subatntially less than the plug threaded portion, the plug being threadably secured to the connector such that the plug surface is sealingly deformed against the connector face and maintained thereagainst, the plug electrically isolating the cable end.

2. The apparatus of claim 1, a longitudinal axis of the flange being substantially parallel to a longitudinal axis of the plug, an inner surface of the flange diverging outwards along a direction away from the plug threaded portion.

3. The apparatus of claim 1, the flange having a conical shape.

4. The apparatus of claim 3, the plug threads being external threads engageable with internal threads of the connector.

5. The apparatus of claim 4, further comprising an elongated elastomeric ring having an unstretched substantially uniform cross-section along its entire length, an unstretched inside diameter of the ring being less than an outside diameter of the plug threads and an outer nut surface surrounding the connector internal threads, the ring being disposed on parts of both the outer nut surface and the plug threads so as to form a seal therebetween.

6. The apparatus of claim 5, further comprising the connector secured to a coaxial cable end.

* * * * *